United States Patent [19]

Sherwin et al.

[11] 4,154,782

[45] May 15, 1979

[54] ALTITUDE FUEL CONTROL VALVE

[75] Inventors: Harry A. Sherwin, Warren; Keith D. Marsh, St. Clair Shores, both of Mich.

[73] Assignee: Colt Industries Operating Corp., New York, N.Y.

[21] Appl. No.: 809,663

[22] Filed: Jun. 24, 1977

[51] Int. Cl.[2] ..... F02M 7/18

[52] U.S. Cl. ..... 261/67; 261/71

[58] Field of Search ..... 261/71, 67, 39 A, 23 A

[56] References Cited

U.S. PATENT DOCUMENTS

| | | | |
|---|---|---|---|
| 1,207,029 | 12/1916 | Guthrie | 261/67 |
| 2,009,109 | 7/1935 | Hunt | 261/67 |
| 3,271,014 | 9/1966 | Wu | 261/67 |
| 3,343,820 | 9/1967 | Elliott | 261/23 A |
| 3,469,825 | 9/1969 | Du Bois | 261/71 |
| 3,588,058 | 6/1971 | Lucas | 261/67 |
| 3,764,119 | 10/1973 | Niebrzydoski | 261/23 A |
| 3,795,387 | 3/1974 | Hebert | 261/67 |
| 3,907,941 | 9/1975 | Herbert et al. | 261/23 A |
| 3,933,951 | 1/1976 | Fischer et al. | 261/67 |
| 4,052,490 | 10/1977 | Fedison | 261/71 |

FOREIGN PATENT DOCUMENTS

| | | | |
|---|---|---|---|
| 1322570 | 7/1973 | United Kingdom | 261/71 |

*Primary Examiner*—Tim R. Miles

*Attorney, Agent, or Firm*—Walter Potoroka, Sr.

[57] ABSTRACT

A carburetor having a fuel bowl, main fuel metering system means and idle fuel metering system means is shown provided with a valve assembly actuatable into either an open or closed condition; in the open position additional fuel from the fuel bowl is bypassed around the main metering restriction as to flow into the main fuel metering system means downstream of such main metering restriction and in the closed position all fuel flowing into the main fuel metering system means flows through the main metering restriction.

2 Claims, 3 Drawing Figures

ALTITUDE FUEL CONTROL VALVE

BACKGROUND OF THE INVENTION

Because of governmentally imposed limitations on vehicular engine exhaust emissions, the automobile industry, generally, has expanded great efforts as to provide fuel metering systems which will provide a rate of metered fuel flow, to the engine, which is very closely aligned to the minimal requirements of such engine. Such calibrations for the metering systems are usually established and checked at or close to sea level elevations. It has been discovered that apparently as a consequence thereof certain problems have occurred. That is, a significant percentage of vehicles are driven over terrains which include both relatively low elevations as well as relatively high elevations or altitudes. Consequently, the rate of metered fuel flow at such respective extremes of altitude is significantly effected because of the relative change in atmospheric pressure which is employed as the reference pressure in determining the effective available metering pressure. Obviously, if the metering calibrations and testing are established for a relatively high altitude then such will not prove to be sufficiently accurate for significantly lower altitude operation.

Accordingly, the invention as herein disclosed and claimed is primarily directed to the solution of the foregoing and attendant and related problems.

SUMMARY OF THE INVENTION

According to the invention, a carburetor assembly comprises an induction passage with throttle valve means therein for controlling the flow of motive fluid therethrough, a fuel reservoir for containing a supply of fuel therein, a main fuel discharge nozzle in said induction passage means, a main fuel metering system communicating between said fuel reservoir and said main nozzle, said main fuel metering system comprising calibrated main fuel metering restriction means, an idle fuel discharge port opening into said induction passage means, an idle fuel metering system communicating between said idle fuel discharge port and said fuel reservoir, said idle fuel metering system comprising calibrated idle fuel metering restriction means, and additional valving means positionable into either an opened or closed condition, said valving means being effective when opened to provide an auxillary flow of fuel from said fuel reservoir to said main fuel metering system at a point downstream of said calibrated main fuel metering restriction means.

Various general and specific objects, aspects and advantages of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
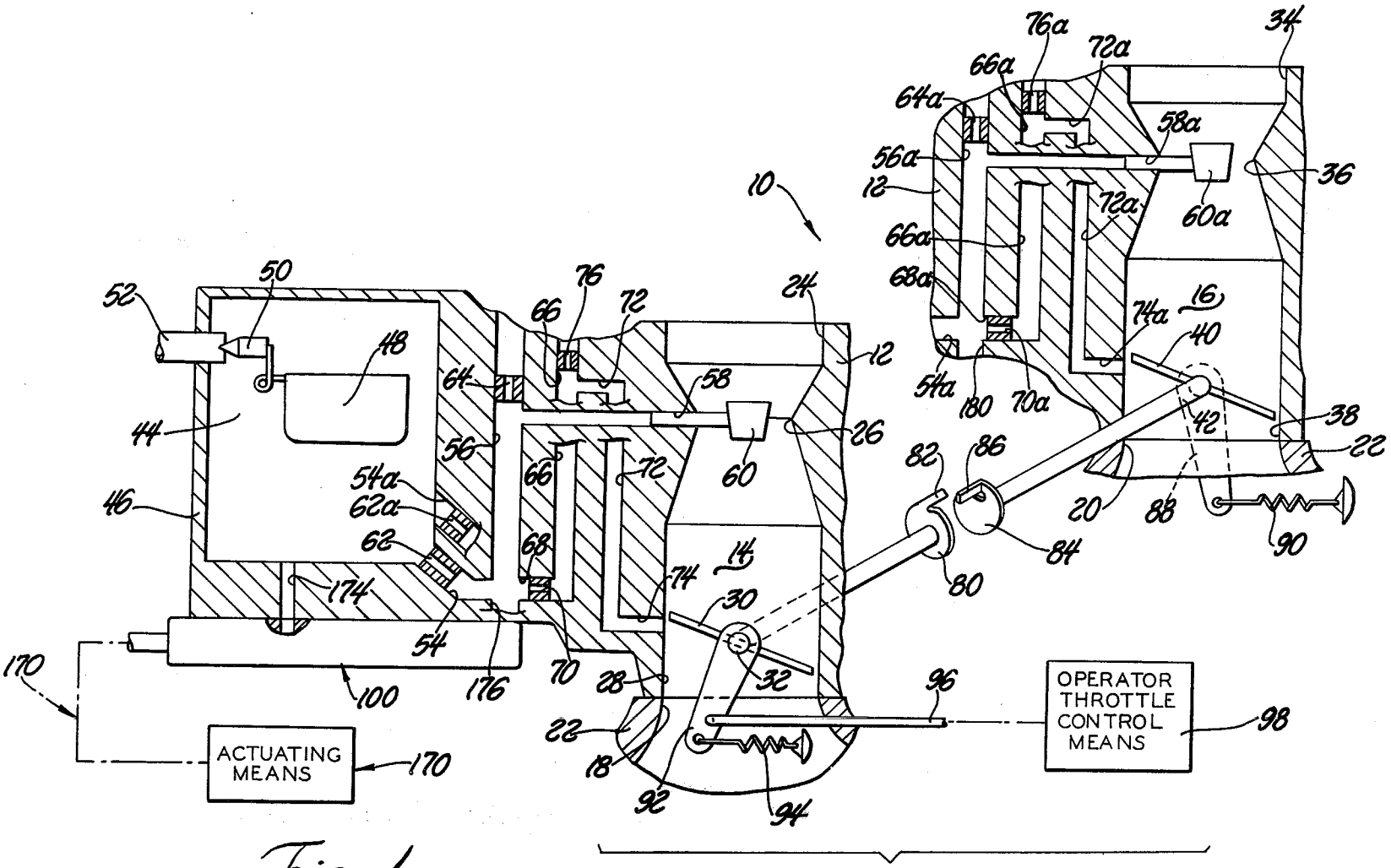
FIG. 1 is a generally diagrammatic view of a carburetor and related fuel metering system employing teachings of the invention.

Referring now in greater detail to the drawings, FIG. 1 diagrammatically illustrates a carburetor 10 having body means 12 with a plurality of induction passage means 14 and 16 formed therethrough respectively communicating with inlet apertures 18 and 20 of an engine intake manifold 22 upon which the carburetor 10 is mounted.

Induction passage 14 may be comprised of an air inlet 24, a main venturi 26 and a mixture outlet 28 in communication with inlet 18 of intake manifold 22. The flow through the induction passage 14 may be controlled by a throttle valve 30 mounted on a shaft 32 for pivotal rotation therewith so as to be variably positionable as by manual operation thereof.

Induction passage means 16 may be comprised of an air inlet 34, a main venturi 36 and a mixture outlet 38 in communication with inlet 20 of intake manifold 22. The flow through the induction passage 16 may be controlled by a throttle valve 40 mounted on a shaft 42 for pivotal rotation therewith so as to be variably positionable as, for example, by means to be described.

Fuel is supplied to the induction passages 14 and 16 from a reservoir 44 which, in the example shown, is a float chamber of a fuel bowl 46 having a float 48 therein which actuates a fuel valve 50 controlling a fuel inlet 52 leading from any suitable source of supply.

With regard to induction passage 14, fuel flows from reservoir or chamber 44 through a conduit 54 and into a main fuel well 56 which, in turn, is in communication with a conduit 58 the other end of which opens within a main fuel discharge nozzle 60 situated generally within the throat of venturi 26. A main fuel calibrated metering restriction 62, situated as within conduit 54 serves to meter the rate of fuel flow from the reservoir chamber 44 to main fuel well 56. Further, as illustrated, and as generally well known in the art, a calibrated main fuel air bleed or air restriction means 64 communicates as between a source of ambient atmospheric pressure and main fuel well 56.

As is often the case, the idle fuel metering system is comprised of an idle fuel well 66 which, generally, at its lower end may be connected to the main fuel well 56 as by conduit means 68 and calibrated idle fuel restriction means 70. In this arrangement, the effective flow area of idle restriction 70 is obviously less than that of main fuel restriction 62 thereby resulting in such main fuel restriction 62 having no restrictive effect on the rate of flow of metered idle fuel through idle fuel restriction 70. The idle fuel well 66 is, in turn, as at its upper end, in communication with conduit means 72 leading to the idle fuel discharge orifice or port means 74 communicating with induction passage 14. Further, as illustrated, and as generally well known in the art, calibrated idle fuel air bleed or air restriction means 76 communicates as between a source of ambient atmosphere and idle fuel well 66.

With regard to induction passage means 16, the various conduits and restrictions comprising the main fuel metering system and the idle fuel metering system serving, generally, to complete communication as between reservoir 44 and induction passage 16 and which function in the manner described with reference to induction passage 14 are identified with like reference numbers provided with a suffix "a".

As is well known in the art, and although not illustrated, adjustably positionable valve means (such as, for example, a (needle-type valve) may be employed in the conduit means 72 and/or 72*a* as in close proximity to the respective discharge orifices 74 and 74*a* in order to closely calibrate the effective discharge area of the conduit means 72 and/or 72*a*.

Further, as is also well known in the art, although not illustrated, suitable inlet air cleaner means may be operatively connected to the carburetor 10 inlets 24 and 34.

In the embodiment illustrated, although the invention is not so limited, induction passage means 14 comprises a primary induction passage while induction passage means 16 comprises a secondary induction passage. Such passages 14 and 16 may be of the same effective flow area or of different effective flow areas with, for example, induction passage means 14 being the smaller of the two.

Further, by way of example and not of limitation, throttle 30 is connected to the throttle shaft 32 which fixedly carries a driving dog arrangement 80 for rotation therewith and which is provided as with an arm or abutment portion 82 while throttle 40 is connected to the throttle shaft 42 which fixedly carries a second dog arrangement 84 for rotation therewith and which is provided with an arm or abutment portion 86 positioned generally in the path of travel of dog arm 82 as to be engagable thereby after throttle valve 30 and throttle shaft 32 have been rotated a predetermined degree in the throttle opening direction from the normally or nominally closed throttle or curb idle position. Throttle shaft 42 and throttle valve 40 are normally urged to the diagrammatically illustrated curb idle position as through a lever 88 fixedly secured to throttle shaft 42 and connected to a return spring 90.

Somewhat similarly, throttle shaft 32 has lever means 92 fixedly secured thereto which, in turn, is operatively connected to return spring means 94 and linkage means 96 leading as to, for example, the vehicle operator's throttle control means 98 (many specific types of which are well known in the art).

It should be made clear that the invention is not limited to the clutch means as generally comprised of dogs 80 and 84, neither is it limited to a mechanical means for causing a delay in the opening of the secondary throttle valve means 40, nor is it limited to having the throttle valves 40 and 30 operate in any staged manner. Further, it should also be made clear that the primary induction passage means 14 may in fact comprise the primary induction passage of what, in the art, is referred to as a carburetor for a stratified-fuel engine wherein the effective flow area through such "stratified carburetor" primary induction passage is substantially less than the effective flow area through the secondary or main induction passage means of such a carburetor.

Also, as shown in FIG. 1, related altitude compensating valving means 100 is shown carried by the carburetor structure 10 as by being located generally below the fuel bowl 46.

Figure 2:
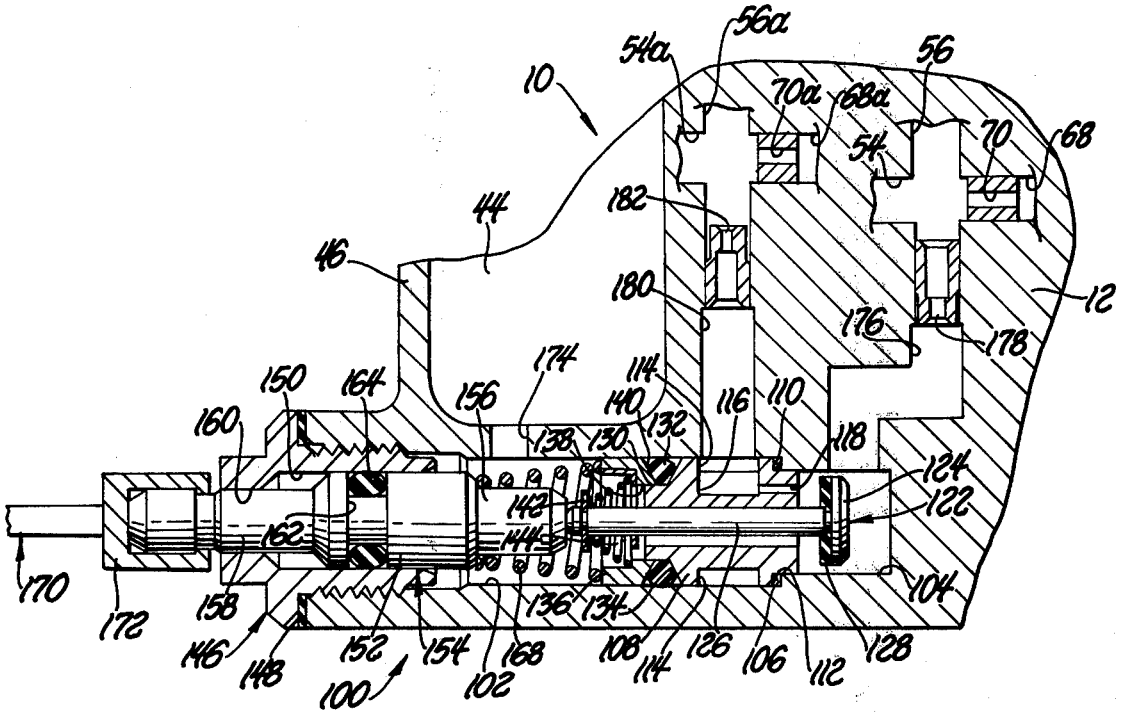
FIG. 2 is an enlarged fragmentary cross-sectional view of a portion of the structure shown in FIG. 1.
Figure 3:
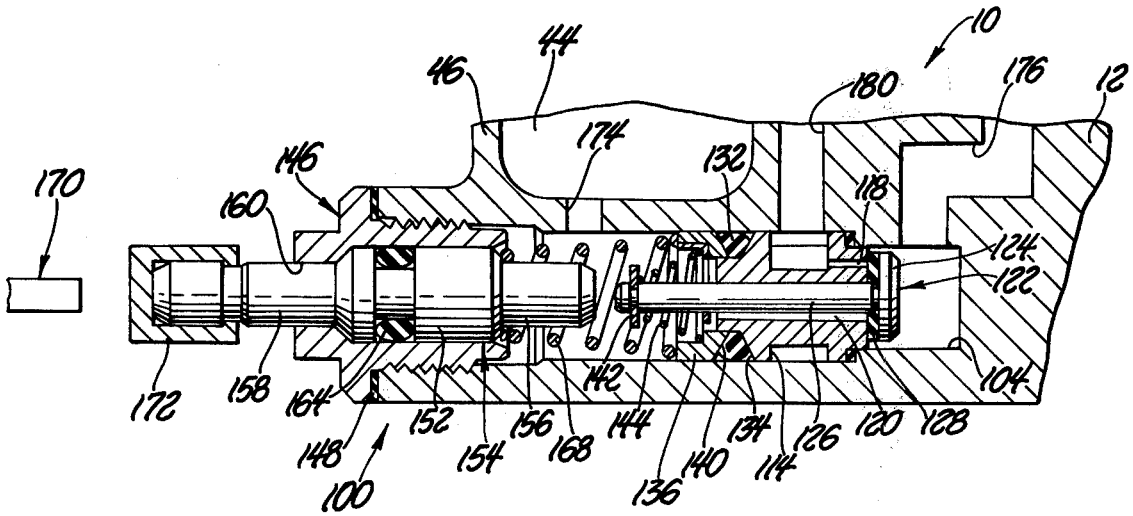
FIG. 3 is a view similar to FIG. 2 and illustrating such structure in a condition of operation other than that shown in FIG. 2.

Referring in greater detail to FIGS. 2 and 3, the valve assembly 100 is illustrated as comprising a generally cylindrical cavity or chamber 102 which, at its right end as viewed in FIG. 2, has a chamber portion 104 of somewhat reduced diameter thereby defining an annular shoulder 106 at such point of stepped diameters. A generally cylindrical valving body 108 is closely received within chamber 102 and is preferably provided with an annular shoulder 110 which, through an annular seal 112, abuts against the face of shoulder or abutment 106. Generally midway between its axial ends, valve body 108 is provided with an annular groove or peripheral recess 114 which is in communication with a radially inwardly extending passage 116 as to thereby be in communication with an axially extending passage or conduit 118 having its right-most end communicating (in the condition depicted in FIG. 2) with chamber 104. Further, valve body 108 is also provided with second axially extending passage means 120 which has its opposite ends effective for communicating with chambers 104 and 102.

A valving member 122 comprising a disc-like head portion 124 and axially extending stem 126 is slidably received, as by its stem 126, by valve body 108. Valving member 122 is also provided with an annular washer-like seal 128 carried about stem 126 as to be axially against the head 124.

The left end (as viewed in FIG. 2) of valve body 108 has a portion 130 of reduced diameter about which an O-ring type seal 132 is situated as to be against an inclined annular surface or shoulder 134 of valve body 108. A generally tubular cup-like seal compression member of sleeve 136 having a centrally formed aperture 138 is closely received within chamber 102 and about portion 130 of valve body 108. The right-most end of member 136 is provided with an inclined annular surface 140 which is inclined in a direction generally opposite to the inclination of shoulder surface 134. Generally at the left end of valve stem 126 is a clip-like spring seat 142 against which one end of a spring 144 is engaged with the other end of such spring 144 being operatively seated against compression member 136. As should be apparent, spring 144 continually urges valving member 122 to the left.

An end closure-like fitting 146 is shown threadably engaged as to have its main body portion generally disposed in the portion at the left of chamber 102. A suitable annular seal 148 is provided as between a flange portion of fitting 146 and a cooperating surface of body means 12. A generally cylindrical passage 150 formed in fitting 146 slidably receives the main body 152 of a plunger-like actuator member 154 which has, at its right end, an extension 156 of relatively reduced diameter as well as an extension 158 of relatively reduced diameter at its left end with such extension 158 being slidably received through clearance passage means 160 in general alignment with passage 150. An annular circumferential groove 162 formed in body 152 receives an O-ring seal 164 therein as to provide for sealing as generally between plunger 154 and chamber 150. A second coiled compression spring 168 is situated generally about extension 156 and abutably engaged with the shoulder portion defined generally by body 152 and extension 156 and at its opposite end also operatively engaged with seal compression member 136.

As somewhat schematically illustrated at 170, suitable actuating means of any suitable configuration may be employed to abuttingly engage the left end of plunger 154, as through a cup-like member 172 if such be employed, in order to move plunger 154 fully to the right to the position generally depicted in FIG. 2. When the influencing effect of such actuating means 170 is removed, as generally depicted in FIG. 3, the force of spring 168 is sufficient to resiliently forcibly move plunger 154 to the left to the position depicted in FIG. 3.

With reference to each of FIGS. 1, 2 and 3, passage or conduit means 174 serves to communicate fuel as from reservoir 44 to chamber 102 generally to the left of valve body 108. Second conduit means 176 preferably comprising calibrated restriction passage means 178 serves to communicate between chamber 104 (generally to the right of valve body 108) and the main fuel well 56 of the primary induction passage means. Also, third conduit means 180 preferably comprising calibrated restriction passage means 182 serves to communicate between the annulus 114 of valve body 108 and main fuel well **56*a* of the secondary induction passage means 16**.

OPERATION OF THE INVENTION

Generally, as is well known in the art, metered idle fuel will flow through the idle fuel metering system and be discharged as through ports 74 and **74*a* into induction passage means 14 and 16 during curb idle engine operation and, to some degree, during off-idle or low part throttle engine operation. Such metered flow is primarily dependent on the pressure differential created across the fuel in the idle fuel metering system (resulting from the difference as between ambient atmosphere and engine manifold vacuum) and the effective metering or flow area of idle fuel metering restriction means such as at 70 and/or 70*a***.

As engine load and speed sufficiently increase, the volume rate of air flow through the respective venturii 26 and 36 causes a sufficient venturi vacuum which (much like the engine manifold vacuum) results in a pressure differential across the fuel with the main fuel metering system sufficient to cause metered main fuel to be discharged through respective main nozzles 60 and **60*a* into induction passages 14 and 16. Similarly, the rate of metered main fuel flow is primarily dependent upon the magnitude of the said pressure differential across the fuel within the main fuel metering system and the effective metering or flow area of main fuel metering restriction means such as at 62 and/or 62*a***.

As was previously mentioned, the venturi vacuum is generated in response to the volume rate of air flow; accordingly, it can be seen that it is possible to obtain the same magnitude of venturi vacuum at both a relatively low altitude and a relatively high altitude and in such case the mass rate of air flow (lbs. per unit of time) will be greater at the said relatively low altitude. The metering of fuel is always calibrated in terms of mass rate of fuel matched to a mass rate of air flow. In other words, the fuel responds in terms of mass rate of flow while the air at relatively high altitudes becomes less dense and the venturi vacuum does not sense the changing density of such air.

Generally, with a denser air (as at sea level) the rate of metered fuel must be increased in order to maintain the desired fuel-air ratio of the resulting combustible mixture or motive fluid.

Accordingly, the invention provides a solution to the above as by calibrating the main metering restriction means 62 and **62*a* to provide the desired rate of metered fuel flow at some preselected relatively high altitude and further provides additional bypass-like calibrated restriction means 178 and 182 which are capable of providing an additional rate of metered fuel flow as to combine with that rate of metered fuel flow through respective restriction means 62 and 62*a*** and result in a second desired rate of metered fuel flow at some preselected relatively low altitude.

This can be better appreciated by specific reference first to FIG. 2 wherein the actuating means 170 has been actuated causing plunger 154 to move to the right engaging stem 126 and moving valving member 122 to the right as generally depicted. In this condition of operation (a relatively low operation where denser air exists) additional fuel flows from reservoir 44 through passage 174 into chamber 102, at the left of valve body 108, through passage means 120 and into chamber portion 104 from where such fuel generally divides into two paths of further flow. One of such paths is from chamber 104 into conduit 176 through metering restriction means 178 and into the main well 56, at a point downstream of main metering restriction 62, of the main fuel metering system feeding fuel to induction passage 14. The other path of flow is from chamber 104 through passage means 118 and through passage means 116, 114 into conduit means 180 and through metering restriction means 182 into the main well **56*a*, at a point downstream of main metering restriction 62*a*, of the main fuel metering system feeding fuel to induction passage 16**.

Accordingly, it can be seen that during this particular condition of operation metering restriction 178, in effect, combines with main metering restriction 62 to provide a relatively enlarged effective metering or flow area as do metering restrictions 182 and **62*a***.

Referring more specifically to FIG. 3, it can be seen that the actuating means 170 has been effectively withdrawn thereby permitting spring 168 to move plunger member 154 to the left to the position generally depicted in FIG. 3. Consequently, spring 144 is also permitted to move valving member 122 to the left as to cause seal member 128 to seat against the right end of valve body 108 and thereby close passage means 120 and 118 to further communication with chamber 104. In this condition of operation (a relatively high altitude operation where less dense air exists) the only path for fuel to flow into the main wells is through respective main fuel metering restrictions 62 and **62*a*. Accordingly, it can be seen that since the effective fuel metering areas are reduced (in comparison to that of FIG. 2** operation) there will be a lesser mass rate of fuel flow for the same magnitude of venturi vacuum which, of course, is the relationship desired when the air flowing into the induction passage means is relatively less dense.

In FIGS. 2 and 3 only one passage 118 and only one passage 120 have been shown. However, it is contemplated, as employed in one successful embodiment tested, that a plurality of each of such passages 118 and 120 may be employed. Such could be done as, for example, angularly spacing such passages alternately about the axis of valve body 108. It is, of course, apparent that in the preferred embodiment neither passage means 118 nor 120 provides any effective restrictive effect upon the flow of fuel therethrough and that such restrictive effects be brought about by the calibrated passage means 178 and 182.

Another feature, which should be apparent, is the fact that when actuating means 170 actuates plunger 154 to the position shown in FIG. 2, spring 168 reacts against member 136 which, in turn, further tends to compress annular seal 132. However, because of the inclinations of opposed surfaces 140 and 134 the seal 132 reacts by moving radially outwardly against the surface of chamber 102 thereby exerting an even greater sealing force.

It will be noted that the invention comprises a carburetor that is calibrated to supply the desired air/fuel ratio to the engine at relatively high elevations or altitudes, the carburetor including manually actuated valve means for supplying additional fuel to richen the mixture at sea level or relatively low elevations. That is, the invention provides manual sea level richening means for an altitude calibrated carburetor.

It will be noted further that the richening valve means is formed in a manner so that it provides additional fuel at sea level operation to the main fuel system of each stage of a multi-stage carburetor, as by parallel fuel passages from a common chamber, for example. However, since it has been found to be important for reasons such as emission control, the structure is such that the main fuel systems of the primary and secondary stages of a two-stage carburetor, for example, are isolated, so that there is no communication therebetween, and thus no effect of one upon the other, when the carburetor is operated in the leaner altitude mode. This is accomplished by the provision of separate primary and secondary main fuel passages, each with a main metering restriction, with the richening fuel being supplied to each of the main fuel passages, downstream of the metering restrictions therein, the richening fuel being controlled by a single valve, which eliminates the communication between the two main fuel systems at altitude when the valve is closed.

Although only a preferred embodiment of the invention has been disclosed and described it is apparent that other embodiments and modifications of the invention are possible within the scope of the appended claims.

We claim:

1. A carburetor for a combustion engine, comprising body means, induction passage means formed through said body means and having an inlet end communicating with a source of air and an outlet end for the discharge of a motive fluid therefrom, a source of fuel, main fuel discharge nozzle means communicating with said induction passage means, idle fuel discharge orifice means communicating with said induction passage means, main fuel metering system means communicating between said source of fuel and said main fuel discharge nozzle means, idle fuel metering system means communicating between said source of fuel and said idle fuel discharge orifice means, said main fuel metering system means comprising first conduit means leading from said source of fuel to said nozzle means, said first conduit means comprising first calibrated main fuel metering restriction means, and second conduit means effective for at least at times communicating between said first conduit means and said source of fuel, said second conduit means comprising valving means actuatable into at least a first open position and a second closed position, said second conduit means also comprising second calibrated main fuel metering restriction means, said second conduit means being effective when said valving means is opened to supply additional amounts of metered fuel flow from said source of fuel to said discharge nozzle means, said valving means comprising a valve body, said valve body being situated within said second conduit means as to generally form a wall therein with an upstream side and a downstream side, first fuel passage means formed through said valve body as to complete communication therethrough from said upstream side to said downstream side, second fuel passage means formed in said valve body effective to complete communication between said downstream side and discharge port means formed in said valve body, a valve member, resilient means normally resiliently urging said valve member to a position whereby said valve member terminates communication between said downstream side and said first and second fuel passages, plunger means effective for at times operatively engaging said valve member to move said valve member against said resilient means and complete said communication between said downstream side and said first and second fuel passages, and second spring means for normally urging said plunger means in a direction generally away from said valve member.

2. A carburetor according to claim 1 and further comprising annular seal means carried generally about said valve body, and seal expansion means operatively engaging said seal means, said expansion means being effective upon said plunger means moving toward said valve member to radially expand said seal means to tightly engage the juxtaposed surface of said second conduit means.

* * * * *